US009636739B1

(12) United States Patent
Yuan

(10) Patent No.: US 9,636,739 B1
(45) Date of Patent: May 2, 2017

(54) ONE-HAND-HANDLED-RIVET GUN

(71) Applicant: Yuyao Tangwen Tool Co., Ltd., Yuyao (CN)

(72) Inventor: Jianming Yuan, Yuyao (CN)

(73) Assignee: YUYAO TANGWEN TOOL CO., LTD, Yuyao (CN)

( * ) Notice: Subject to any disclaimer, the term of this patent is extended or adjusted under 35 U.S.C. 154(b) by 0 days.

(21) Appl. No.: 15/275,477

(22) Filed: Sep. 26, 2016

(30) Foreign Application Priority Data

Aug. 17, 2016 (CN) ..... 2016 1 0701172
Aug. 17, 2016 (CN) ..... 2016 2 0916259 U

(51) Int. Cl.

| | |
|---|---|
| ***B21J 15/34*** | (2006.01) |
| ***B21J 15/10*** | (2006.01) |
| ***B21J 15/16*** | (2006.01) |
| ***B21J 15/20*** | (2006.01) |
| ***B21J 15/04*** | (2006.01) |
| ***B21J 15/38*** | (2006.01) |

(52) U.S. Cl.
CPC ..... *B21J 15/105* (2013.01); *B21J 15/043* (2013.01); *B21J 15/16* (2013.01); *B21J 15/205* (2013.01); *B21J 15/386* (2013.01)

(58) Field of Classification Search
CPC ..... B21J 15/205; B21J 15/386; B21J 15/043; B21J 15/105; B21J 15/16
USPC ..... 29/243.521
See application file for complete search history.

(56) References Cited

U.S. PATENT DOCUMENTS

| | | | | |
|---|---|---|---|---|
| 3,100,578 | A * | 8/1963 | Halverson | B21J 15/043 29/243.521 |
| 3,280,615 | A * | 10/1966 | Molitor | B21J 15/043 279/28 |
| 4,136,547 | A * | 1/1979 | Ewig, Jr. | B21J 15/043 29/243.527 |
| 4,347,729 | A * | 9/1982 | Mitani | B21J 15/043 29/243.528 |
| 4,520,648 | A * | 6/1985 | Gregory | B21J 15/043 29/243.527 |
| 4,653,308 | A * | 3/1987 | Gregory | B21J 15/043 29/243.5 |
| 6,021,553 | A * | 2/2000 | Bieber | B21J 15/043 29/243.521 |

(Continued)

*Primary Examiner* — David B Jones
(74) *Attorney, Agent, or Firm* — Wayne & King LLC

(57) ABSTRACT

The present invention discloses a one-hand-handled rivet gun, which has a handle seat with a through hole, a folding mechanism hinged to the handle seat and a pulling rod connected to the folding mechanism. The mentioned pulling rod is coated by a housing, and is equipped with a riveting gun tip assembly on the front end. A fixed sleeve is mounted on the front end of the housing of the pulling rod, and a guiding nipple is mounted on the front end of the fixed sleeve. The mentioned folding mechanism comprises two folding rod assemblies symmetrically mounted behind both sides of the rear end of the pulling rod, and the two folding rod assemblies include a front curved link and rear curved link hinged to each other. A handle cover is connected to the rear end of the rear curved link, and the front curved link is fixed to the pulling rod by the front end and hinged to the front end of the handle seat. Therefore, the invented one-hand-handled rivet gun can be used with only one hand, which is easy for people to use.

6 Claims, 4 Drawing Sheets

(56) References Cited

U.S. PATENT DOCUMENTS 8,307,525 B2 * 11/2012 Gregory ..... B21J 15/205
29/243.521
8,776,338 B2 * 7/2014 Yuan ..... B21J 15/386
29/243.521

* cited by examiner

ONE-HAND-HANDLED-RIVET GUN

CROSS-REFERENCE TO RELATED APPLICATIONS

This application claims priority benefit of Chinese Patent Application No. 201610701172.0 with a filing date of Aug. 17, 2016, and No. 201620916259.5 with a filing date of Aug. 17, 2016. The content of the aforementioned applications, including any intervening amendments thereto, are incorporated herein by reference.

TECHNICAL FIELD

The present invention relates to the field of riveting tools, and specifically it is a one-hand-handled rivet gun.

BACKGROUND OF THE PRESENT INVENTION

Riveter is used for fastening and riveting of sheet metal, pipes and other manufacturing industries, and now it is widely used for riveting of elevators, switches, instruments, furniture, decorations and other mechanical and electrical products, as well as light industry.

Folding rivet gun is a kind of rivet guns, which usually includes a handle, a folding frame and a riveting tip. The rivet gun shall be used by stretching the folding frame to achieve the riveting of rivets. Since the telescopic frame will be long after stretching, people need to use the gun with two hands. Specifically, people need to use one hand to hold the front end of the rivet gun, and use another hand to hold the handle of the rivet gun. When the handle is pulled back, the front end of the folding frame will pull the riveting tip back, thereby riveting the rivet. The original rivet gun is of some difficulty for people to use.

Therefore, how to develop a one-hand-handled and folded rivet gun is a research focus of people working in this field.

SUMMARY OF PRESENT INVENTION

In view of the deficiencies of the existing technology, the object of the present invention is to provide a one-hand-handled rivet gun, which is convenient for people to use.

The technology solution is as follows: the one-hand-handled rivet gun comprises a handle seat with a through hole, a folding mechanism hinged to the handle seat and a pulling rod connected to the folding mechanism. The mentioned pulling rod is coated by a housing, and is equipped with a riveting gun tip assembly on the front end. A fixed sleeve is mounted on the front end of the housing of the pulling rod, and a guiding nipple is mounted on the front end of the fixed sleeve. The mentioned folding mechanism comprises two folding rod assemblies symmetrically mounted behind both sides of the rear end of the pulling rod, and the two folding rod assemblies include a front curved link and rear curved link hinged to each other. There are two front curved links for each folding rod assembly. A handle cover is connected to the rear end of the rear curved link, and the front curved link is fixed to the pulling rod by the front end and hinged to the front end of the handle seat.

Further, the mentioned rear curved link is hinged to the front curved link by the front end via a connecting shaft.

Further, two rear curved links are hinged to each other by the rear ends via the first axis pin. The mentioned handle cover is provided with a neck on the front end, and there is a fixing spacer mounted on both the upper and lower ends of the neck. And there is a slid slot on both the two fixing spacers. Wherein one of the rear curved links is provided with a second axis pin by the rear end, and the second axis pin is hinged to two fixing spacers by the upper and lower ends; while the other rear curved link is provided with a third axis pin by the rear end, and the third axis pin achieves a snug fit with the slid slot on two fixing spacers by the upper and lower ends.

Further, both of two front curved links are provided with a locating axis by the front end, as well as two notches on both sides of the rear end. And the mentioned locating axis shall lock into the notch.

Further, the mentioned front curved links shall be hinged to the front end of the handle seat by the front ends via a hinge axis.

Further, the mentioned pulling rod is provided with an axially disposed axis core, and the mentioned riveting gun tip assembly is mounted to the front end of the core mounted on the shaft, and it shall be sequentially mounted on the crawling, ejector pin and spring inside the axis core. The front end of spring shall be pressed against the rear end of the ejector pin.

The present one-hand-handled rivet gun is of the following benefits: Stretch the folding rod assembly first, and then put the rivet on the guide nipple; handle the handle seat and press the rear curved link backward, and then the front end of the front curved link will move backward to drive the pulling rod backward, letting the riveting gun tip assembly drive the rivet core to move backward. Finally, the rivet will be riveted. The present riveting gun can be used with only one hand, so as to facilitate the use.

Parts in the diagram: 1-handle seat, 1.1-through-hole, 2-folding mechanism, 21-folding rod assembly, 211-front curved link, 212-rear curved link, 3-pulling rod, 31-axis core, 4-housing, 5-riveting tip assembly, 51-claw seat 52-claw, 53-ejector pin, 54-spring, 6-fixed sleeve, 7-guiding nipple, 8-handle cover, 81-neck, 9-connecting shaft, 10-first axis pin, 11-fixing spacer, 12-slid slot, 13-second axis pin, 14-third axis pin, 15-locating axis, 16-notch, 17-hinge axis.

DETAILED DESCRIPTION OF PREFERRED EMBODIMENTS

Figure 1:
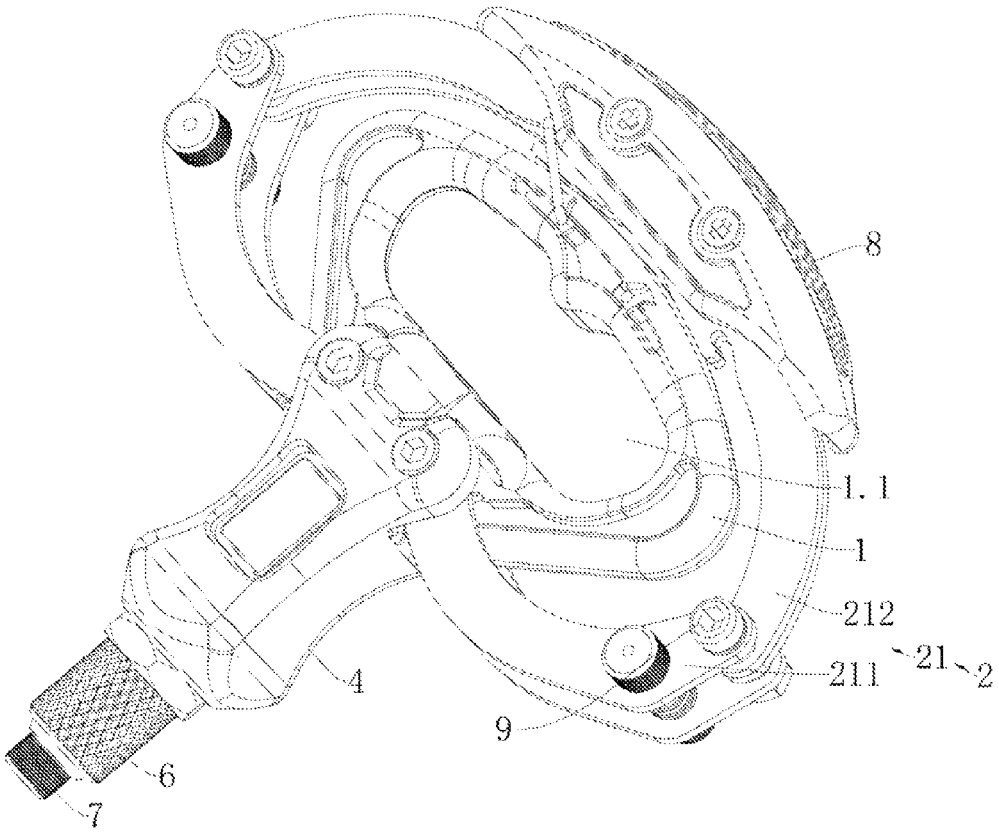
FIG. 1 is the diagram for the overall structure of the invention.
Figure 2:
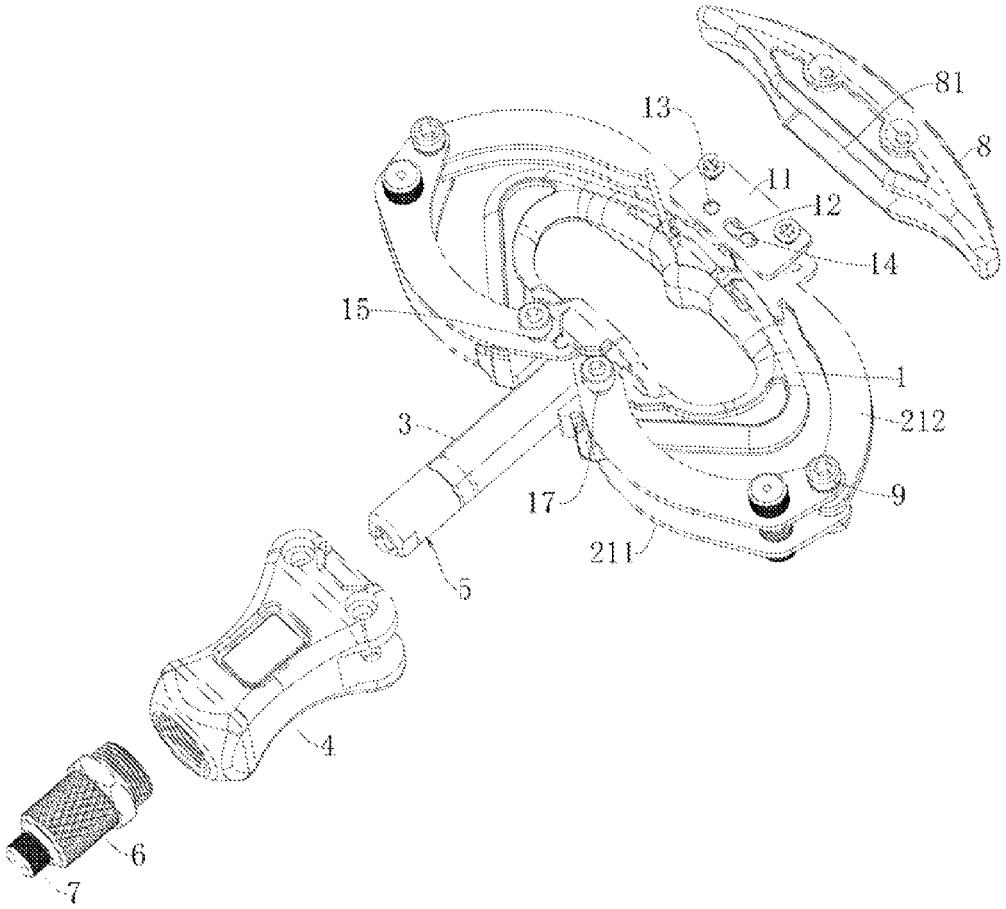
FIG. 2 is the exploded view of the invention.
Figure 3:
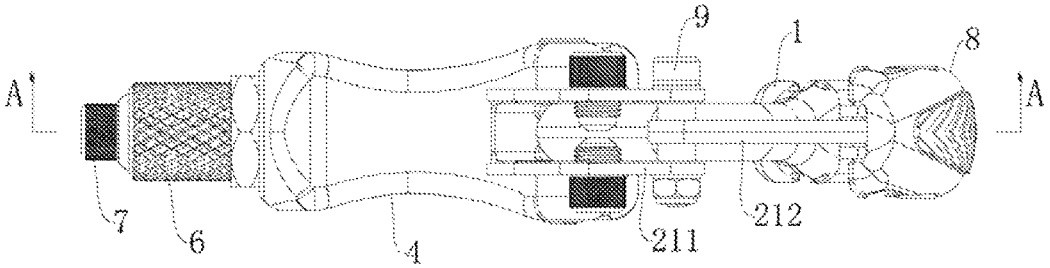
FIG. 3 is the side view of the invention.
Figure 4:
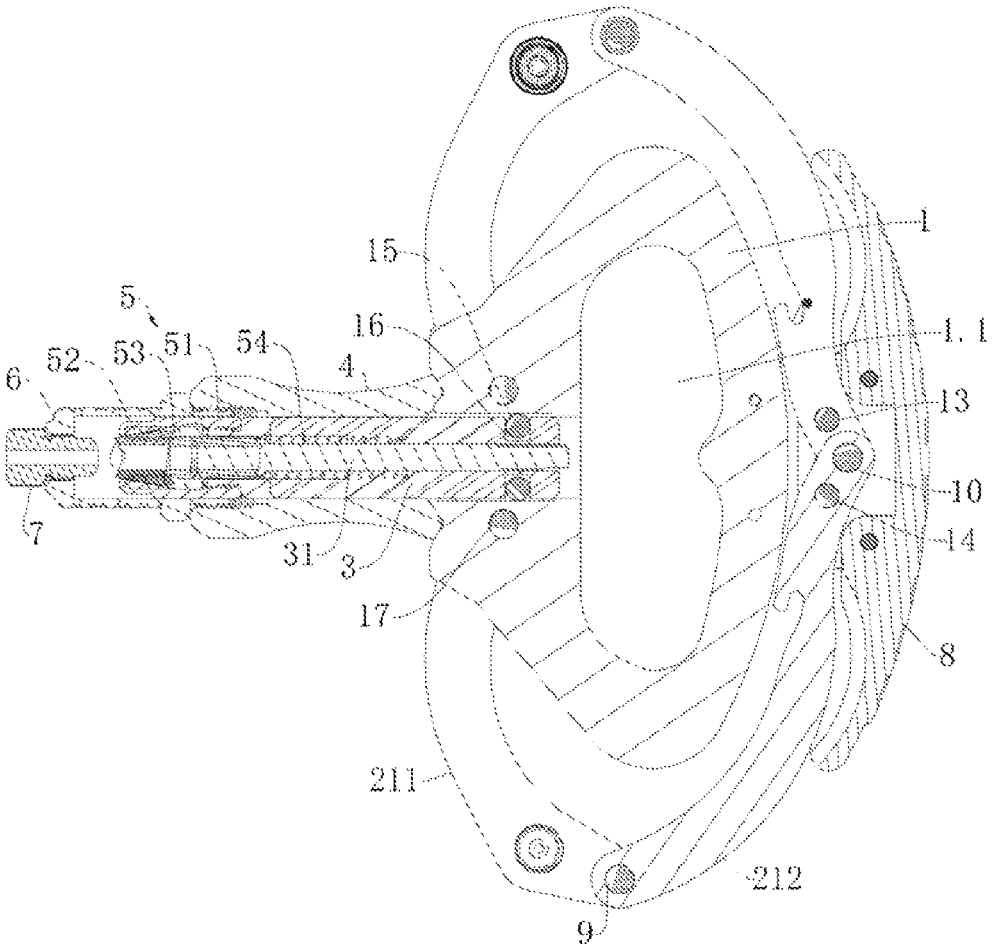
FIG. 4 is the section A-A view in FIG. 3.

In order to make people have a clearer and more complete understanding of the technical solution of the present invention, here the following non-limiting features are described with the attached figures:

As is shown in FIG. 1, FIG. 2, FIG. 3 and FIG. 4, the one-hand-handled rivet gun comprises a handle seat 1 with a through hole 1.1, a folding mechanism 2 hinged to the handle seat 1 and a pulling rod 3 connected to the folding mechanism 2. The mentioned pulling rod 3 is coated by a housing 4, and is equipped with a riveting gun tip assembly 5 on the front end. A fixed sleeve 6 is mounted on the front end of the housing 4 of the pulling rod 3, and a guiding nipple 7 is mounted on the front end of the fixed sleeve 6. The mentioned folding mechanism 2 comprises two folding rod assemblies 21 symmetrically mounted behind both sides of the rear end of the pulling rod 3, and the two folding rod assemblies 21 include a front curved link 211 and rear curved link 212 hinged to each other. There are two front curved links for each front curved link 211. A handle cover 8 is connected to the rear end of the rear curved link 212, and the front curved link 211 is fixed to the pulling rod 3 by the front end and hinged to the front end of the handle seat 1.

The rear curved link 212 is hinged to the front curved link 211 by the front end via a connecting shaft 9. Two rear curved links 212 are hinged to each other by the rear ends via the first axis pin 10. The mentioned handle cover 8 is provided with a neck 81 on the front end, and there is a fixing spacer 11 mounted on both the upper and lower ends of the neck 81. And there is a slid slot 12 on both the two fixing spacers 11. Wherein one of the rear curved links 212 is provided with a second axis pin 13 by the rear end, and the second axis pin 13 is hinged to two fixing spacers 11 by the upper and lower ends; while the other rear curved link 212 is provided with a third axis pin 14 by the rear end, and the third axis pin 14 achieves a snug fit with the slid slot 12 on two fixing spacers 11 by the upper and lower ends.

In order to make the front curved link 211 fix with the pulling rod 3, both of two front curved links 211 are provided with a locating axis 15 by the front end, and a notch 16 is provided to both sides of the rear end of pulling rod 3. And the mentioned locating axis 15 shall lock into the notch 16.

In order to make the front curved link 211 connect to the handle seat 1, the front curved links 211 shall be hinged to the front end of the handle seat 1 by the front ends via a hinge axis 17.

The pulling rod 3 is provided with an axially disposed axis core 31, and the riveting gun tip assembly 5 is mounted to the front end of the core axis 31 mounted on the shaft via thread connection, and it shall be sequentially mounted on the claw 52, ejector pin 53 and spring 54 inside the axis core 31. The front end of spring 54 shall be pressed against the rear end of the ejector pin 53. Stretch the folding rod assembly 21 first, and then insert the rivet into the guide nipple 7, the rear end of the rivet core will be locked by the claw 52; handle the handle seat 1 and press the rear curved link 212 backward, and then the front end of the front curved link 211 will move backward to drive the pulling rod 3 backward, letting the riveting gun tip assembly 5 drive the rivet core to move backward. Finally, the rivet will be riveted. The present riveting gun can be used with only one hand, so as to facilitate the use.

Of course, these are only preferred examples of the invention only, and it shall not confine the patentable scope of the present invention. All products which make use of the specification and drawings of the present invention with simple modifications and equivalent structures shall be included in the scope of patent protection of the present invention.

I claim:

1. A one-hand-handled rivet gun, comprising:

a handle seat with a through hole, wherein the handle seat has a front end and a rear end;

a folding mechanism hinged to the handle seat, wherein the folding mechanism comprises two folding rod assemblies, wherein each of the two folding rod assemblies comprises a front curved link and a rear curved link hinged to each other, and wherein both the front curved link and the rear curved link have a front end and a rear end; and a pulling rod connected to the folding mechanism, wherein the pulling rod has a front end and a rear end, wherein the pulling rod is enclosed within a housing and is equipped with a riveting gun tip assembly on the front end of the pulling rod, wherein the housing has a front end and a rear end, wherein a fixed sleeve is mounted on the front end of the housing, wherein the fixed sleeve has a front end and a rear end, and wherein a guiding nipple is mounted on the front end of the fixed sleeve, wherein the two folding rod assemblies are symmetrically connected to the rear end of the pulling rod, wherein a handle cover is connected to the rear end of the rear curved link, and wherein the front end of the front curved link is fixed to the pulling rod and hinged to the front end of the handle seat.

2. The one-hand-handled rivet gun according to claim 1, wherein the front end of the rear curved link is hinged to the rear end of the front curved link via a connecting shaft.

3. The one-hand-handled rivet gun according to claim 2, wherein the rear ends of the two rear curved links are hinged to each other via a first axis pin;

wherein the handle cover comprises a front end and a rear end, wherein a slot is placed at the front end of the handle cover, wherein the slot has an upper end and a lower end, wherein a fixing spacer is mounted on both the upper and lower ends of the slot, and wherein a slid slot is mounted on each of the two fixing spacers;

wherein one of the rear curved links is provided with a second axis pin at the rear end, wherein the second axis pin has an upper end and a lower end wherein the upper and lower ends of the second axis pin are hinged to the two fixing spacers; and wherein the rear end of the other rear curved link is provided with a third axis pin, wherein the third axis pin has an upper end and a lower end, and wherein each of the upper and lower ends of the third axis pin is a sliding fit to each of the slid slots on the two fixing spacers.

4. The one-hand-handled rivet gun according to claim 3, wherein each of the front ends of the two front curved links is provided with a locating axis, wherein the rear end of the pulling rod has two opposite sides, wherein a notch is placed at each side of the rear end of the pulling rod, and wherein each locating axis locks into each notch.

5. The one-hand-handled rivet gun according to claim 4, wherein the the front ends of the two front curved links are hinged to the front end of the handle seat via a hinge axis.

6. The one-hand-handled rivet gun according to claim 1, wherein the an axis core is axially mounted inside the pulling rod, wherein the axis core comprises a front end and a rear end, wherein the riveting gun tip assembly comprises a shaft, a claw hinge, an ejector pin and a spring, wherein the shaft is mounted to the front end of the axis core via threaded connection, wherein the spring has a front end and a rear end, wherein the claw hinge, the ejector pin and the spring are sequentially placed within the front end of the axis core, and wherein the front end of the spring is pressed against the rear end of the pulling rod.

* * * * *